United States Patent [19]
Nakazawa et al.
[11] 4,447,514
[45] May 8, 1984

[54] ORGANIC PHOTOSENSITIVE MATERIAL FOR ELECTROPHOTOGRAPHY COMPRISING POLYVINYLCARBAZOLE AND PYRENE OR PHENANTHRENE

[75] Inventors: Toru Nakazawa, Osaka; Akira Fushida, Suita; Yasushi Kamezaki, Sakai, all of Japan

[73] Assignee: Mita Industrial Co., Ltd., Osaka, Japan

[21] Appl. No.: 472,277

[22] Filed: Mar. 4, 1983

[30] Foreign Application Priority Data

Mar. 5, 1982 [JP] Japan ..... 57-34097

[51] Int. Cl.³ ..... G03G 5/06
[52] U.S. Cl. ..... 430/81; 430/58; 430/900; 430/83
[58] Field of Search ..... 430/81, 58, 900, 71, 430/83

[56] References Cited

U.S. PATENT DOCUMENTS

| | | | |
|---|---|---|---|
| 3,887,369 | 6/1975 | Matsuno et al. | 430/86 X |
| 4,116,695 | 9/1978 | Mori et al. | 430/164 |
| 4,220,697 | 2/1980 | Wiedemann | 430/58 |
| 4,301,229 | 11/1981 | Sakaki et al. | 430/155 X |
| 4,340,658 | 7/1982 | Inoui et al. | 430/88 X |

*Primary Examiner*—John D. Welsh
*Attorney, Agent, or Firm*—Sherman & Shalloway

[57] ABSTRACT

Disclosed is an organic photosensitive material for electrophotography comprising a charge-transporting medium composed mainly of polyvinyl carbazole and a perylene type pigment as a charge-generating pigment dispersed in said charge-transporting medium, wherein 1 to 30 parts by weight of a halo-naphthoquinone and 1 to 100 parts by weight of phenanthrene or pyrene are incorporated per 100 parts by weight of the polyvinyl carbazole.

This photosensitive material is excellent in the sensitivity and the resistance to the repeated light exposure.

8 Claims, 1 Drawing Figure

ORGANIC PHOTOSENSITIVE MATERIAL FOR ELECTROPHOTOGRAPHY COMPRISING POLYVINYLCARBAZOLE AND PYRENE OR PHENANTHRENE

BACKGROUND OF THE INVENTION (1) Field of the Invention

The present invention relates to an organic photosensitive material for electrophotography. More particularly, the present invention relates to an improvement in a photosensitive material comprising a polyvinyl carbazole type charge-transporting medium and a perylene type charge-generating pigment dispersed in said medium, wherein the sensitivity is increased and the fatigue at the repeated light exposure is prevented.

(2) Description of the Prior Art

As the conventional single-layer type photosensitive material comprising a charge-transporting medium and a charge-generating pigment dispersed therein, there is known a photosensitive material comprising a phthalocyanine type or dis-azo pigment dispersed in a medium composed mainly of polyvinyl carbazole. However, it is admitted that a photosensitive material comprising a perylene pigment dispersed in polyvinyl carbazole (hereinafter referred to as "PVK") has no practically applicable sensitivity.

It is known that various sensitizers may be incorporated so as to sensitize a photosensitive layer comprising a charge-generating pigment dispersed in a charge-transporting medium. However, when these known sensitizers are applied to the combination of PVK and the perylene pigment, most of these known sensitizers are still insufficient in the sensitivity and the charge potential or the adaptability to the repeated light exposure.

We already found that a halo-naphthoquinone has a substantially satisfactory sensitizing effect to the PVK-perylene pigment combination. However, a photosensitive material in which this halo-naphthoquinone is incorporated is still insufficient in that the fatigue at the repeated light exposure, that is, the light memory effect, is extreme and the initial saturation charge voltage is drastically reduced on the surface of the photosensitive material by the repeated light exposure.

SUMMARY OF THE INVENTION

We found that when phenanthrene or pyrene is incorporated together with a halo-naphthoquinone into a photosensitive layer of the PVK-perylene pigment dispersion structure, the fatigue at the repeated light exposure is prominently controlled as compared with the case where a halo-naphthoquinone alone is incorporated and the sensitivity is remarkably improved. We have now completed the present invention based on this finding.

More specifically, in accordance with the present invention, there is provided an organic photosensitive material for electrophotography comprising a charge-transporting medium composed mainly of polyvinyl carbazole and a perylene type pigment as a charge-generating pigment dispersed in said charge-transporting medium, wherein 1 to 30 parts by weight of a halo-naphthoquinone and 1 to 100 parts by weight of phenanthrene or pyrene are incorporated per 100 parts by weight of the polyvinyl carbazole.

DETAILED DESCRIPTION OF THE INVENTION

Figure 1:
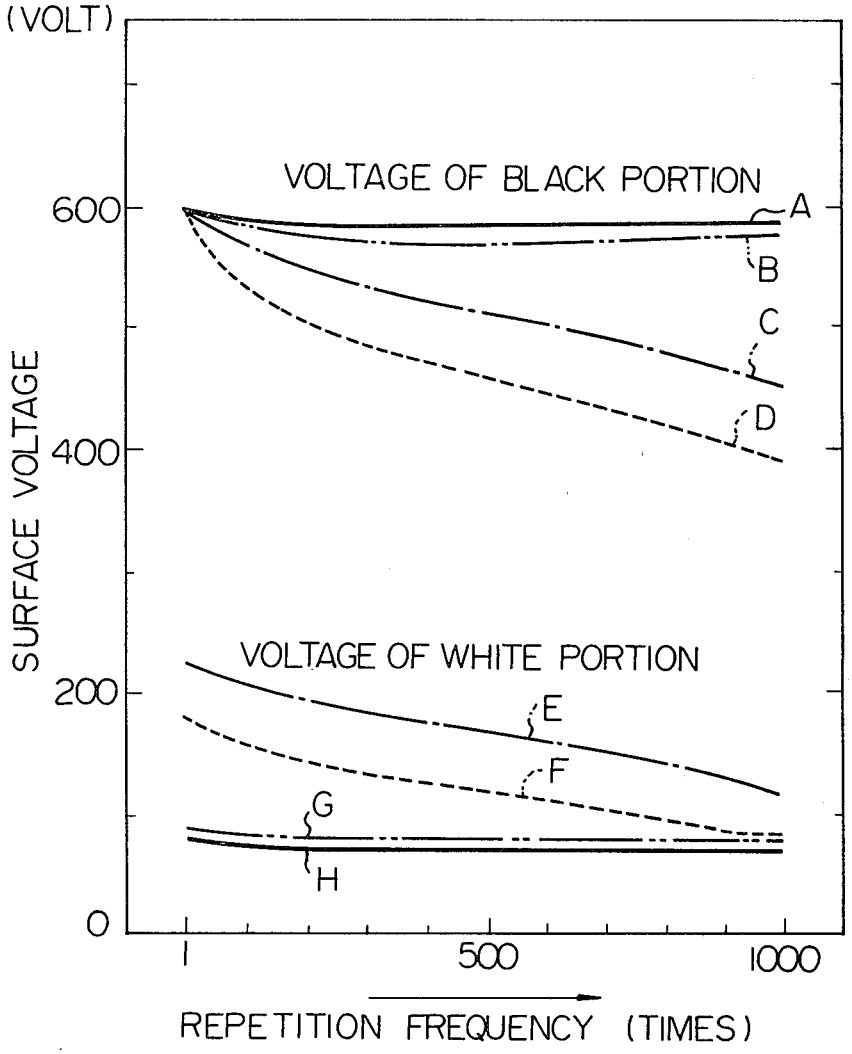
FIG. 1 is a graph illustrating the results of the repeated light exposure test made on a photosensitive plate of the present invention and a comparative photosensitive plate in a practical copying machine.

The halo-naphthoquinone that is used in the present invention may be represented by the following general formula:

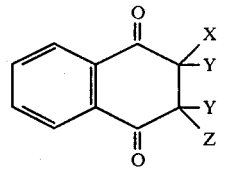

(1)

wherein X stands for a halogen atom, Z stands for a halogen or hydrogen atom, and Y stands for a hydrogen atom, with the proviso that two hydrogen atoms as Y may be removed to form a carbon-to-carbon double bond.

It is ordinarily preferred that in the above general formula, the halogen atom be a chlorine or bromine atom. As preferred examples of the halo-naphthoquinone, there can be mentioned 2-chloro-1,4-naphthoquinone, 2,3-dichloro-1,4-naphthoquinone, 2,3-dibromo-1,4-naphthoquinone and 2,3-dichloro-2,3-dihydro-1,4-naphthoquinone.

As the other sensitizing agent to be used in combination with the halo-naphthoquinone, there can be mentioned phenanthrene of the following formula:

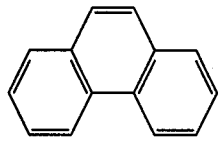

(2)

and pyrene of the following formula:

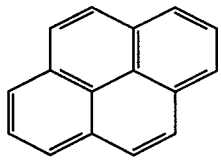

(3)

in order of preference.

The sensitivity of a photosensitive layer for electrophotography is expressed by the exposure quantity (lux·sec) for the half decay of the potential. The sensitivity of the photosensitive layer of the PVK-perylene pigment dispersion type having no sensitizing agent incorporated therein is 30 to 50 lux·sec, and if a halo-naphthoquinone is incorporated into this photosensitive layer, the sensitivity is improved to 18 to 23 lux·sec. However, the fatigue of this photosensitive layer having the halo-naphthoquinone incorporated therein at the time of the repeated light exposure is extreme. For example, if the light exposure is repeated 1000 times, the charge voltage after the repeated light exposure is reduced to about ⅔ to about ½ of the initial value.

Even if phenanthrene or pyrene alone is incorporated in a photosensitive layer of the PVK-perylene pigment dispersion type, no appreciable sensitizing effect can be attained.

On the other hand, if both the components are incorporated in combination into a photosensitive layer of the above-mentioned type according to the present invention, the fatigue at the time of the repeated light exposure is prominently controlled and the sensitivity can be improved to a level of 15 to 18 lux·sec.

In the present invention, it is important that 1 to 30 parts by weight, especially 3 to 15 parts by weight, of the halo-naphthoquinone and 1 to 100 parts by weight, especially 5 to 50 parts by weight, of phenanthrene or pyrene should be used per 100 parts by weight of PVK.

If the amount of the halo-naphthoquinone or the amount of phenanthrene or pyrene is too small and below the above range, the sensitivity is reduced and the intended objects of the present invention cannot be attained. If the amount of the halo-naphthoquinone is too large and exceeds the above range, the electrophotographic characteristics, especially the charge potential, at the time of the repeated light exposure are reduced. If the amount of phenanthrene or pyrene is too large and exceeds the above range, this additive component is precipitated as crystals and formation of a film of the photosensitive layer becomes difficult.

Polyvinyl carbazole is a polymer consists of the recurring units represented by the following formula:

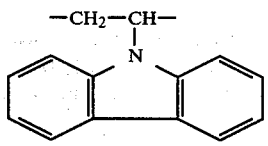

(4)

and this polymer has a film-forming property and is included in the category of the electron-donative resin. In the present invention, a nucleus substitution product of this polymer, for example, a halogen- or nitro-substituted polymer, may similarly be used.

In the present invention, it also is important that a perylene pigment should be used as the photoconductive or charge-generating pigment to be dispersed in the medium comprising polyvinyl carbazole, the halo-naphthaoquinone and phenanthrene or pyrene. The reason is that the combination of the halo-naphthoquinone and phenanthrene or pyrene has a peculiarly excellent sensitizing effect to the combination of polyvinyl carbazole and a perylene pigment.

As the perylene pigment, there may be used a known pigment represented by the following general formula:

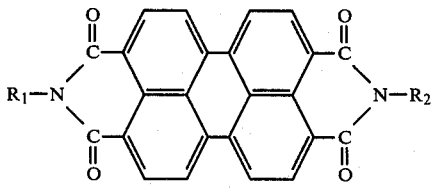

(5)

wherein $R_1$ and $R_2$ stand for a hydrogen atom or a substituted or unsubstituted alkyl or aryl group.

As preferred examples of the substitutent, there can be mentioned a hydroxyl group, an alkoxy group, an amino group, a nitro group and a halogen atom.

As preferred examples of the perylene pigment, there can be mentioned N,N'-dimethylperylene-3,4,9,10-tetracarboxylic acid diimide, N,N'-di(3,5-dimethylphenyl)perylene-3,4,9,10-tetracarboxylic acid diimide, N,N'-di(4-ethoxyphenyl) perylene-3,4,9,10-tetracarboxylic acid diimide and N,N'-di(4-toluyl)perylene-3,4,9,10-tetracarboxylic acid diimide, though perylene pigments that can be used in the present invention are not limited to those exemplified above.

It is important that the perylene pigment should be used in an amount of 5 to 50 parts by weight, especially 10 to 30 parts by weight, per 100 parts by weight of polyvinyl carbazole. If the amount of the perylene pigment is too small and below the above range, no satisfactory sensitivity can be obtained, and if the amount of the perylene pigment is too large and exceeds the above range, both the initial saturation charge voltage and the sensitivity tend to decrease.

In accordance with one preferred embodiment of the present invention, other photoconductive pigment is used in combination with the above-mentioned perylene pigment. As such photoconductive pigment, there can be mentioned phthalocyanine pigments and disazo pigments. If such pigment having a sensitivity to red color wavelengths is used in an amount of 2 to 10 parts by weight per 100 parts by weight of the perylene pigment, the sensitivity to red color wavelengths can be increased and the photosensitive wavelength region of the photosensitive layer can be rendered panchromatic.

In order to increase the mechanical strength of the photosensitive layer and improve the adhesion to a conductive substrate, there may be used a binder having no photoconductivity, for example, a polyester resin, an epoxy resin, a polycarbonate resin, a polyurethane resin, a xylene resin, an acrylic resin or a styrene-butadiene copolymer. This binder may be used in an amount of 0.1 to 50 parts by weight, especially 10 to 30 parts by weight, per 100 parts by weight of polyvinyl carbazole.

In order to improve the surface smoothness of the photosensitive layer, there may be used a levelling agent such as polydimethylsiloxane in an amount of 0.005 to 5 parts by weight per 100 parts by weight of polyvinyl carbazole.

The photosensitive composition of the present invention is coated as a layer having a certain thickness on a photoconductive substrate and is used in the form of a photosensitive material for electrophotography.

As the conductive substrate, there may be used a foil, plate, sheet or drum of a metal such as aluminum, copper, tin or tinplate. Moreover, there may be used a substrate prepared by depositing a metal such as mentioned above on a film base such as a biaxially stretched polyester film or a glass sheet by vacuum evaporation deposition, sputtering or non-electrolytic plating. Moreover, there may be used Nesa glass as the conductive substrate.

The coating composition is prepared by dispersing the perylene pigment, optionally with a phthalocyanine or disazo pigment, in a good solvent for polyvinyl carbazole such as tetrahydrofuran, dichloroethane or toluene-cyclohexanone by ultrasonic vibration or high shearing agitation and dissolving polyvinyl carbazole, the halo-naphthoquinone and phenanthrene or pyrene into the dispersion. From the viewpoint of the adaptability to the coating operation, it is preferred that the solid concentration of the so-formed coating composition be 5 to 12% by weight.

From the viewpoint of the electrophotographic characteristics, it is preferred that the thickness of the layer of the photosensitive composition after drying be 3 to 30μ, especially 8 to 15μ.

As will be apparent from Examples given hereinafter, the photosensitive composition of the present invention has an excellent sensitivity whether it may be subjected to positive charging or negative charging. However, if the photosensitive layer is subjected to positive charging and then subjected to imagewise light exposure, a further enhanced sensitivity can be obtained.

The present invention will now be described in detail with reference to the following Examples that by no means limit the scope of the present invention.

EXAMPLE 1

A coating composition comprising the following components was prepared.

| | |
|---|---|
| Poly-N—vinyl carbazole | 100 parts by weight |
| N,N'—Di(4-ethoxyphenyl)-perylene-3,4,9,10-tetra-carboxylic acid diimide | 8 parts by weight |
| 2,3-Dichloro-1,4-naphthoquinone | 20 parts by weight |
| Phenanthrene | 40 parts by weight |
| Polycarbonate resin (Panlite L supplied by Teijin Limited) | 10 parts by weight |
| Tetrahydrofuran | 147 parts by weight |

The above coating composition was charged in a ball mill of stainless steel and was dispersed for 24 hours to obtain a homogeneous coating composition. The composition was coated on an aluminum plate having a thickness of 80 μm and dried at 80° C. for 1 hour to form a photosensitive plate having a photosensitive layer thickness of 15 μm.

The so-prepared photosensitive plate was allowed to stand still in the dark place over two days and nights, and was then subjected to the following test.

(A) Measurement of Electrophotographic Characteristics (Sensitivity)

Measurement device: electrostatic paper analyzer supplied by Kawaguchi Denki K.K.

Measurement condition: applied voltage of +6.0 Kvolt

Measurement mode: static measurement, stat. 2

Quantity of irradiation: 40 luxes

(B) Measurement in Actual Machine (Resistance to Repeated Light Exposure)

The photosensitive plate was attached to a copying machine (Model DC-162 supplied by Mita Industrial Co.), and the light exposure was repeated 1000 cycles while measuring the surface voltage by using a potentiometer.

The results of the measurements (A) and (B) are shown in Table 1 and FIG. 1. Incidentally, in FIG. 1, curve A shows the voltage of the black portion of the photosensitive plate prepared in Example 1 and curve H shows the voltage of the white portion of the same photosensitive plate.

EXAMPLE 2

A coating composition comprising the following components was prepared.

| | |
|---|---|
| Poly-N—vinyl carbazole | 100 parts by weight |
| N,N'—Di(4-toluyl)perylene-3,4,9,10-tetracarboxylic acid diimide | 10 parts by weight |
| 2,3-Dichloro-1,4-naphthoquinone | 18 parts by weight |
| Pyrene | 20 parts by weight |
| Polycarbonate resin (Panlite L supplied by Teijin Limited) | 10 parts by weight |
| Tetrahydrofuran | 150 parts by weight |

In the same manner as described in Example 1, this coating composition was dispersed, coated and dried, and the obtained photosensitive plate was tested in the same manner as described in Example 1. The obtained results are shown in Table 1 and FIG. 1.

Incidentally, in FIG. 1, curve B shows the voltage of the black portion of the photosensitive plate obtained in Example 2 and curve G shows the voltage of the white portion of the same photosensitive plate.

Comparative Example 1

A comparative photosensitive plate was prepared in the same manner as described in Example 1 except that phenanthrene was not added to the coating composition. The photosensitive plate was tested in the same manner as described in Example 1. The obtained results are shown in Table 1 and FIG. 1.

Incidentally, in FIG. 1, curved D shows the voltage of the black portion of this comparative photosensitive plate and curve F shows the voltage of the white portion of the same photosensitive plate.

Comparative Example 2

A comparative photosensitive plate was prepared in the same manner as described in Example 1 except that 2,3-dichloro-1,4-naphthoquinone was not added to the coating composition. The photosensitive plate was tested in the same manner as described in Example 1. The obtained results are shown in Table 1 and FIG. 1.

Incidentally, in FIG. 1, curve C shows the voltage of the black portion of this photosensitive plate and curve E shows the voltage of the white portion of the same photosensitive plate.

TABLE 1

Results of Measurement of Electrophotographic Characteristics

| | Surface Potential (volt) | Sensitivity (lux · sec) |
|---|---|---|
| Example 1 | +750 | 15.0 |
| Example 2 | +740 | 15.4 |
| Comparative Example 1 | +745 | 21.0 |
| Comparative Example 2 | +750 | 27.0 |

From the foregoing measurement results, it is seen that the photosensitive plate of the present invention is comparable to the comparative photosensitive plate in the surface potential, but the former photosensitive plate is much superior to the latter photosensitive plate in the sensitivity.

Moreover, at the repeated light exposure, the photosensitive plate of the present invention stably maintains a high surface potential in the black portion, and in the white portion of the photosensitive plate of the present invention, a low potential is maintained from the start of the experiment. Accordingly, it is confirmed that the photosensitive plate of the present invention is excellent in the resistance to the repeated light exposure. In the other hand, in the comparative photosensitive plate, the surface potential of the black portion is reduced by more than 150 V when the light exposure is repeated 1000 times, and the surface potential of the white portion is increased by more than 100 V when the light exposure is repeated 1000 times. Accordingly, it is confirmed that the comparative photosensitive plate is insufficient in both the sensitivity and the resistance to the repeated light exposure.

What is claimed is:

1. An organic photosensitive material for electrophotography comprising a charge-transporting medium composed mainly of polyvinyl carbazole and a perylene type pigment as a charge-generating pigment dispersed in said charge-transporting medium, wherein 1 to 30 parts by weight of a halo-naphthoquinone and 1 to 100 parts by weight of phenanthrene or pyrene are incorporated per 100 parts by weight of the polyvinyl carbazole.

2. A photosensitive material as set forth in claim 1, wherein the amount of the perylene type pigment is 5 to 50 parts by weight per 100 parts by weight of the polyvinyl carbazole.

3. A photosensitive material as set forth in claim 1, wherein the halo-naphthoquinone is a compound represented by the following general formula:

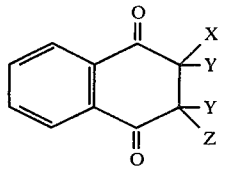

wherein X stands for a halogen atom, Z stands for a halogen or hydrogen atom, and Y stands for a hydrogen atom, with the proviso that two hydrogen atoms as Y may be removed to form a carbon-to-carbon double bond.

4. A photosensitive material as set forth in claim 1, wherein the halo-naphthoquinone is 2,3-dichloro-1,4-naphthoquinone or 2,3-dibromo-1,4-naphthoquinone.

5. A photosensitive material as set forth in claim 1, wherein the perylene pigment is a pigment represented by the following general formula:

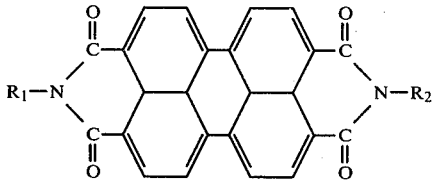

wherein $R_1$ and $R_2$ stand for a hydrogen atom or a substituted or unsubstituted alkyl or aryl group.

6. A photosensitive material as set forth in claim 1, which further comprises a phthalocyanine pigment or disazo pigment in an amount of 2 to 10 parts by weight per 100 parts by weight of the perylene pigment.

7. A photosensitive material as set forth in claim 1, which further comprises a resin binder having no photoconductivity in an amount of 0.1 to 50 parts by weight per 100 parts by weight of the polyvinyl carbazole.

8. A photosensitive material as set forth in claim 1, which further comprises a levelling agent in an amount of 0.005 to 5 parts by weight per 100 parts by weight of the polyvinyl carbazole.

* * * * *